US011970835B2

(12) United States Patent
Zhao et al.

(10) Patent No.: US 11,970,835 B2
(45) Date of Patent: Apr. 30, 2024

(54) GRADER AND SLOPE SCRAPING CONTROL METHOD AND DEVICE THEREOF

(71) Applicant: JIANGSU XCMG CONSTRUCTION MACHINERY RESEARCH INSTITUTE LTD., Jiangsu (CN)

(72) Inventors: Bin Zhao, Jiangsu (CN); Hao Liao, Jiangsu (CN); Hao Liu, Jiangsu (CN); Ju He, Jiangsu (CN)

(73) Assignee: JIANGSU XCMG CONSTRUCTION MACHINERY RESEARCH INSTITUTE LTD., Jaingsu (CN)

( * ) Notice: Subject to any disclaimer, the term of this patent is extended or adjusted under 35 U.S.C. 154(b) by 674 days.

(21) Appl. No.: 17/136,193

(22) Filed: Dec. 29, 2020

(65) Prior Publication Data

US 2022/0112684 A1 Apr. 14, 2022

(30) Foreign Application Priority Data

Oct. 14, 2020 (CN) ..... 202011098061.8

(51) Int. Cl.
*E02F 3/84* (2006.01)
*E02F 3/76* (2006.01)

(52) U.S. Cl.
CPC ..... *E02F 3/844* (2013.01); *E02F 3/7668* (2013.01); *E02F 3/7672* (2013.01); *E02F 3/7677* (2013.01)

(58) Field of Classification Search
CPC ..... E02F 3/844; E02F 3/7668; E02F 3/7672; E02F 3/7677
See application file for complete search history.

(56) References Cited

U.S. PATENT DOCUMENTS 4,273,196 A * 6/1981 Etsusaki ..... E02F 3/841 250/203.3
5,107,932 A * 4/1992 Zachman ..... E02F 3/845 172/1
5,551,518 A * 9/1996 Stratton ..... E02F 3/845 701/50
7,588,088 B2 * 9/2009 Zachman ..... E02F 3/765 701/50
8,103,417 B2 * 1/2012 Gharsalli ..... E02F 3/844 318/587
8,985,233 B2 * 3/2015 Padilla ..... E02F 3/7645 172/795
9,540,793 B2 * 1/2017 Kami ..... G01C 15/00
(Continued)

*Primary Examiner* — Jamie L McGowan
(74) *Attorney, Agent, or Firm* — Myers Bigel, P.A.

(57) ABSTRACT

A grader and slope scraping control method and device include a grader having a front frame; a blade mounted on the front frame, an attitude of the blade is adjustable; an actuator for adjusting the attitude of the blade; a first angle detecting member for detecting a first inclination angle in a front and rear direction of the grader relative to a horizontal plane and a second inclination angle in a left and right direction relative to a horizontal plane; a blade detecting member for detecting attitude information of the blade relative to the front frame; and a controller, for obtaining an actual slope angle based on the first inclination angle, second inclination angle and attitude information, and make the actuator adjust attitude of the blade to a target slope angle when the actual slope angle is inconsistent with the preset target slope angle.

14 Claims, 4 Drawing Sheets

(56) References Cited

U.S. PATENT DOCUMENTS

| | | | | |
|---|---|---|---|---|
| 9,745,726 | B2 * | 8/2017 | Kanemitsu | G01C 9/00 |
| 10,030,366 | B2 * | 7/2018 | Tevis | E02F 3/7654 |
| 10,066,367 | B1 * | 9/2018 | Wang | E02F 9/265 |
| 10,428,493 | B2 * | 10/2019 | Omelchenko | E02F 3/7659 |
| 2009/0056961 | A1 * | 3/2009 | Gharsalli | E02F 3/844 172/779 |
| 2018/0016769 | A1 * | 1/2018 | Omelchenko | G01S 19/14 |
| 2018/0266082 | A1 * | 9/2018 | Tanishige | E02F 9/2285 |
| 2019/0360174 | A1 * | 11/2019 | Kawamoto | G01S 5/163 |
| 2020/0115884 | A1 * | 4/2020 | Christofferson | E02F 3/841 |
| 2020/0173135 | A1 * | 6/2020 | Gentle | E02F 3/7627 |
| 2020/0173136 | A1 * | 6/2020 | Gentle | E02F 3/7663 |
| 2020/0173137 | A1 * | 6/2020 | Gentle | E02F 3/765 |
| 2020/0173138 | A1 * | 6/2020 | Gentle | E02F 3/844 |
| 2020/0173140 | A1 * | 6/2020 | Gentle | E02F 3/7659 |
| 2021/0340735 | A1 * | 11/2021 | Veasy | E02F 3/7627 |

* cited by examiner

GRADER AND SLOPE SCRAPING CONTROL METHOD AND DEVICE THEREOF

CROSS-REFERENCE TO RELATED APPLICATIONS

The present disclosure is based on and claims priority to China Patent Application No. 202011098061.8 filed on Oct. 14, 2020, the disclosure of which is incorporated by reference herein in its entirety.

FIELD OF THE DISCLOSURE

The present disclosure relates to the technical field of graders, and in particular to a grader and a slope scraping control method and device thereof.

BACKGROUND OF THE DISCLOSURE

The grader is an engineering machine for large-area field leveling, road repairing, slope scraping, trenching, side channel trimming, drainage ditch, snow removal, soil loosening, soil bulldozing, wasteland reclamation and other working conditions. In highway as well as agriculture and forestry operations, graders may be often used to perform slope scraping operations to meet the design requirements in engineering.

At present, in order to meet the requirements for a slope scraping angle in construction, during the operation, the grader man observes a position of the blade, and manually adjusts actions of actuators such as the left linear drive member, the right linear drive member, the diagonal linear drive member, the side-shift cylinder and the rotary motor, so as to implement controlling a constant value of the slope angle. However, the construction road surface is uneven, which causes the whole machine to not be in a horizontal state, so that there is a need to control and implement by depending on the experience of the grader man. Since there is a large error, the slope angle formed is often too different from a target value, and there is a need to recondition by multiple repeated operations, so that it is time-consuming and labor-intensive, with a low degree of automation.

SUMMARY OF THE DISCLOSURE

According to a first aspect of the present disclosure, a grader is provided. The grader includes:

a front frame;

a blade, mounted on the front frame, wherein an attitude of the blade relative to the front frame is adjustable;

an actuator, configured to adjust the attitude of the blade;

a first angle detecting member, configured to detect a first inclination angle in a front and rear direction of the grader relative to a horizontal plane and a second inclination angle in a left and right direction of the grader relative to a horizontal plane;

a blade detecting member, configured to detect attitude information of the blade relative to the front frame; and a controller, configured to obtain an actual slope angle of the blade based on the first inclination angle, the second inclination angle and the attitude information, and cause action of the actuator to adjust the attitude of the blade to a preset target slope angle when the actual slope angle is inconsistent with the preset target slope angle.

In some embodiments, the blade detecting member includes:

a second angle detecting member, configured to detect a rotary angle of the blade relative to the front frame; and a third angle detecting member, configured to detect a swing angle of the blade relative to the front frame;

wherein the controller is configured to obtain the actual slope angle of the blade based on the first inclination angle, the second inclination angle, the rotary angle and the swing angle.

In some embodiments, the first angle detecting member is arranged on the front frame; and/or the second angle detecting member is arranged on the blade.

In some embodiments, the grader further including:

a traction frame, connected below the front frame through a ball hinge;

a swing lever;

two swing frames, each of which has a first hinge portion, a second hinge portion and a third hinge portion, wherein the respective second hinge portions of the two swing frames are hinged to the front frame, and the respective third hinge portions of the two swing frames are respectively hinged to both ends of the swing lever; and a left linear drive member and a right linear drive member, wherein the respective first ends are hinged to the respective first hinge portions of the two swing frames respectively, and the respective second ends are hinged to a left end and a right end of the traction frame respectively;

wherein the third angle detecting member is arranged at a position where the second hinge portion of at least one of the swing frames is hinged to the front frame.

In some embodiments, the actual slope angle is an included angle between a normal vector of a combined plane of the grader and a front and rear direction when the ground is horizontal, and a vector of the grader in a forward direction and a vector of the blade in a lower edge direction is located within the combined plane.

In some embodiments, the grader further including a traction frame and a rotary ring, wherein the traction frame is connected below the front frame through a ball hinge, and the rotary ring is arranged below the traction frame, and the blade is connected below the rotary ring, and the actuator including:

a left linear drive member, wherein a first end of the left linear drive member is rotatably connected to the front frame, and a second end of the left linear drive member is rotatably connected to a left end of the traction frame and configured to drive the left end of the traction frame to move up and down;

a right linear drive member, wherein a first end of the right linear drive member is rotatably connected to the front frame, and a second end of the right linear drive member is rotatably connected to a right end of the traction frame and configured to drive the right end of the traction frame to move up and down;

a diagonal linear drive member, configured to drive the traction frame to tilt and swing relative to the front frame; and a rotation drive member, configured to drive rotation of the rotary ring.

In some embodiments, the controller is configured to cause the actuator to make an adjustment according to a sequence of three groups of priorities when the actual slope angle is inconsistent with the preset target slope angle, and shift to a next group of priority to make an adjustment when actions in a group of priority reach a limit position but have not been adjusted to the preset target slope angle;

wherein the three groups of priorities include: a first priority, which includes at least one action of the left linear drive member and the right linear drive member; a second priority, which includes an action of the diagonal linear drive member; and a third priority, which includes an action of the rotation drive member to drive rotation of the rotary ring.

In some embodiments, the controller is configured to determine that the preset target slope angle cannot be reached when the actual slope angle has not reached the preset target slope angle after action of the actuator according to the three groups of priorities.

In some embodiments, the controller is configured to determine an action direction of the actuator according to a left and right slope scraping direction as well as a size relationship between the actual slope angle and the preset target slope angle, in the case where the actual slope angle is inconsistent with the preset target slope angle.

According to a second aspect of the present disclosure, a slope scraping control method of a grader is provided. The method includes the steps of:

detecting a first inclination angle in a front and rear direction of the grader relative to a horizontal plane and a second inclination angle in a left and right direction of the grader relative to a horizontal plane by a first angle detecting member;

detecting attitude information of a blade relative to a front frame by a blade detecting member;

obtaining an actual slope angle of the blade based on the first inclination angle and the attitude information of the blade by a controller; and causing action of the actuator by the controller, so as to adjust an attitude of the blade to an target slope angle when the actual slope angle is inconsistent with the preset target slope angle.

In some embodiments, the step of obtaining an actual slope angle of the blade based on the first inclination angle and the attitude information of the blade by a controller includes:

obtaining a rotary angle of the blade relative to a front frame detected by a second angle detecting member;

obtaining a swing angle of the blade relative to the front frame detected by a third angle detecting member;

obtaining an actual slope angle of the blade based on the first inclination angle, the second inclination angle, the rotary angle, and the swing angle by the controller.

In some embodiments, the step of obtaining an actual slope angle of the blade based on the first inclination angle, the second inclination angle, the rotary angle, and the swing angle by the controller includes:

calculating a vector of the grader in a forward direction based on the first inclination angle and the second inclination angle;

calculating a vector of the blade in a lower edge direction based on the first inclination angle, the second inclination angle, the rotary angle and the swing angle;

calculating a normal vector of a combined plane formed by the vector in the forward direction and the vector in the lower edge direction; and calculating an included angle between the normal vector of the combined plane and the left and right direction as the actual slope angle.

In some embodiments, the step of causing action of the actuator when the actual slope angle is inconsistent with the preset target slope angle includes:

causing the actuator to make an adjustment according to a first priority when the actual slope angle is inconsistent with the preset target slope angle, wherein the first priority includes at least one action of a left linear drive member and a right linear drive member;

making an adjustment according to a second priority when the actuator reaches a limit position through actions in the first priority and has not been adjusted to the preset target slope angle, wherein the second priority includes an action of a diagonal linear drive member;

making an adjustment according to a third priority when the actuator reaches a limit position through actions in the second priority and has not been adjusted to the preset target slope angle wherein the third priority includes an action of the rotary drive member to drive rotation of the rotary ring.

In some embodiments, the slope scraping control method of a grader further including that:

causing the actuator to make an adjustment according to the three groups of priorities, and if the actual slope angle still does not reach the preset target slope angle, it is determined that the preset target slope angle cannot be reached.

In some embodiments, the step of causing action of the actuator when the actual slope angle is inconsistent with the preset target slope angle includes:

determining a left and right direction of the grader to perform slope scraping operation;

determining a size relationship between the actual slope angle and the preset target slope angle;

determining an action direction of the actuator according to the left and right slope scraping direction and the size relationship between the actual slope angle and the preset target slope angle, in the case that the actual slope angle is inconsistent with the preset target slope angle.

In some embodiments, the step of causing action of the actuator when the actual slope angle is inconsistent with the preset target slope angle includes:

when the grader performs a left slope scraping operation, and the actual slope angle is less than the preset target slope angle, a sequence of priorities in adjusting the actuator includes: a first priority, including a right linear drive member first extended and a left linear drive member then shortened; a second priority, including a diagonal linear drive member shortened; and a third priority, including a rotary drive member driving a rotary ring to rotate clockwise; and/or when the grader performs a left slope scraping operation and the actual slope angle is greater than the target slope angle, a sequence of priorities in adjusting the actuator includes: a first priority, including a right linear drive member first shortened and a left linear drive member then extended; a second priority, including a diagonal linear drive member extended; and a third priority, including a rotary drive member driving a rotary ring to rotate counterclockwise; and/or when the grader performs a right slope scraping operation and the actual slope angle is less than the target slope angle, a sequence of priorities in adjusting the actuator includes: a first priority, including a left linear drive member first extended and a right linear drive member then shortened; a second priority, including a diagonal linear drive member extended; and a third priority, including a rotary drive member driving a rotary ring to rotate counterclockwise; and/or when the grader performs a right slope scraping operation and the actual slope angle is greater than the target slope angle, a sequence of priorities in adjusting the actuator includes: a first priority, including a left linear drive member first shortened and a right linear drive member then extended; a second priority, including a diagonal linear drive member shortened; and a third priority, including a rotary drive member driving a rotary ring to rotate clockwise.

In some embodiments, the slope scraping control method of a grader further including:

causing the actuator to stop an adjustment action when the actual slope angle is adjusted to reach the preset target slope angle.

According to a third aspect of the present disclosure, a slope scraping control device for a grader is provided. The device includes:

a memory; and a processor coupled to the memory, wherein the processor is configured to implement the slope scraping control method of a grader according to the above embodiments based on instructions stored in the memory.

According to a fourth aspect of the present disclosure, a computer-readable storage medium having computer program instructions stored thereon, wherein the instructions, when executed by a processor, implement the slope scraping control method of a grader according to according to the above embodiments.

BRIEF DESCRIPTION OF THE ACCOMPANYING DRAWINGS

The accompanying drawings described herein which are intended to provide a further understanding of the present disclosure, constitute a part of the present application. The illustrative embodiments of the present disclosure as well as the descriptions thereof, which are used for explaining the present disclosure, do not constitute improper definitions on the present disclosure. In the accompanying drawings.

DETAILED DESCRIPTION OF THE PREFERRED EMBODIMENTS

Figure 1:
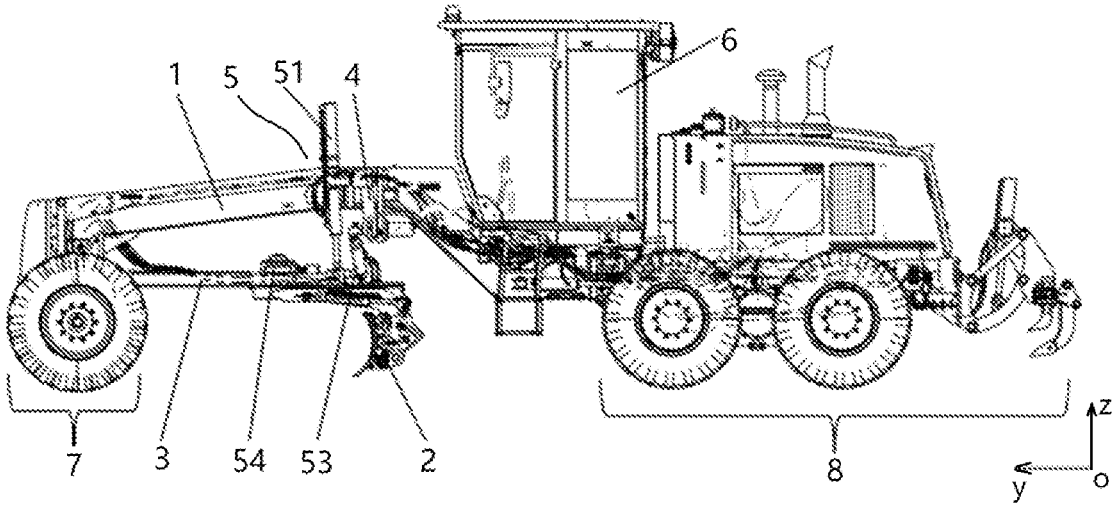
FIG. 1 is a side view of some embodiments of the grader according to the present disclosure.

The present disclosure will be explained in detail below. In the following paragraphs, different aspects of the embodiments will be defined in more detail. Each aspect thus defined may be combined with any other aspect or aspects unless it is specifically indicated that combination is impossible. In particular, any feature that is considered to be preferred or advantageous may be combined with one or more other features that are considered to be preferred or advantageous.

The terms "first" and "second" recited in the present disclosure are merely for ease of description, to distinguish different constituent parts having the same name, rather than indicating a sequential or primary-secondary relationship.

In addition, when an element is referred to as being "on" another element, it may be directly on another element, or one element or may be indirectly on another element with one or more intermediate elements therebetween.

In addition, when an element is referred to as being "connected to" another element, the element may be directly connected to another element, or may be indirectly connected to another element with one or more intermediate elements therebetween. In the following, the same reference numerals present the same elements.

Figure 2:
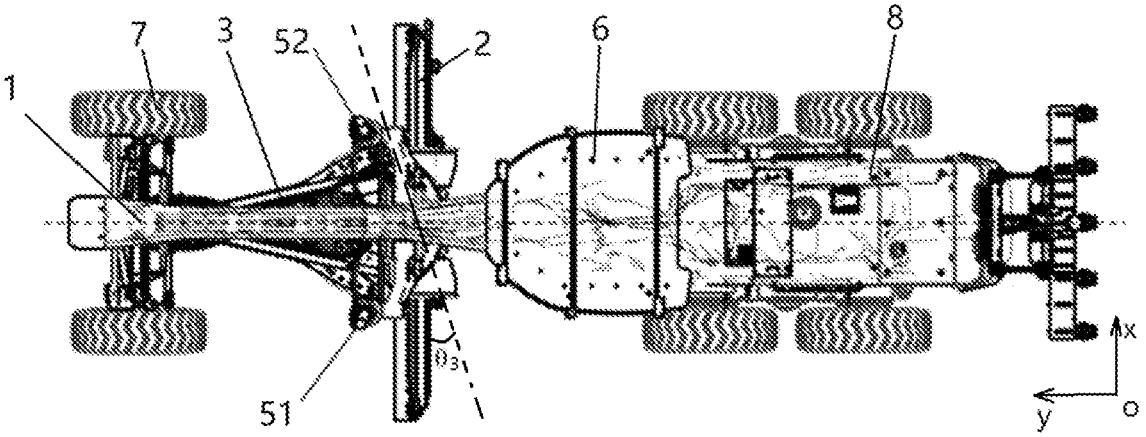
FIG. 2 is a top view of some embodiments of the grader according to the present disclosure.

For example, as shown in FIG. 1 and FIG. 2, the absolute coordinate system is defined. When the grader is on a level ground, a left and right direction of the grader is defined as an x direction, a front and back direction is defined as a y direction, and a up and down direction is defined as an z direction. However, when the grader travels, the ground is difficult to maintain an absolutely flat state, so that the grader may tilt, which results in that the direction under the absolute coordinate system deviates from the direction of the grader itself. In the following embodiments, "the front and back direction", "the left and right direction" and "the up and down direction" are defined relative to the direction of the grader itself, and by the direction in which the driver is seated within the grader.

Based on the above-described definition, the present disclosure uses descriptions of the orientational or positional relationship indicated by wordings such as "upper", "lower", "top", "bottom", "front", "rear", "inner" and "outer", which are all directions defined on the basis of the grader itself. This is only for the convenience of describing the present disclosure, rather than indicating or implying that the device referred thereto has to have a specific orientation, or be constructed and operated in a specific orientation, and therefore cannot be understood as limiting the protection scope of the present disclosure.

The embodiments of the present disclosure provide a grader and a slope scraping control method and device thereof, which can improve the construction accuracy and work efficiency in slope scraping by the grader.

The grader of the embodiment of the present disclosure, when calculating the actual slope angle, in addition to considering the attitude of the blade relative to the grader, it also fully considers the influence of the road surface roughness on the actual slope angle, and the actual slope angle can be accurately obtained. The grader controls the slope angle in real time during the slope scraping operation, so that the actual slope angle is consistent with the preset target slope angle, which can improve the accuracy of the slope scraping construction operation, reduce the error, avoid multiple repeated repair operations, and improve the construction Efficiency and degree of automation, and suitable for complex construction conditions.

In some embodiments, as shown in FIG. 1 to FIG. 5, the present disclosure provides a grader, comprising: a front frame 1, a blade 2, an actuator, a first angle detecting member 9, a blade detecting member 10, and a controller 11. In addition, the grader also comprises a front axle steering portion 7, a rear axle frame assembly and aft-mounted jig 8, and a cab 6.

The blade 2 is mounted on the front frame 1, and an attitude of the blade 2 relative to the front frame 1 may be adjusted. The actuator 5 is configured to adjust the attitude of the blade 2 relative to the front frame 1.

When the ground on which the grader travels is uneven, the grader might tilt in the front and rear direction and the left and right direction. The first angle detecting member 9 is configured to detect a first inclination angle θ1 of the grader in the front and rear direction relative to a horizontal plane and a second inclination angle θ2 in the left and right direction relative to a horizontal plane. For example, the first angle detecting member 9 may be a gyro angle sensor, a potentiometer, a rotary encoder, and other sensors capable of implementing angle detection. The first angle detecting member 9 may use a dual-axis tilt sensor to simultaneously detect the inclination angle of the grader in the front and rear direction and the left and right direction relative to a horizontal plane.

The blade detecting member 10 is configured to detect the attitude information of the blade 2 relative to the front frame 1.

The controller 11 is configured to obtain an actual slope angle of the blade 2 according to the first inclination angle θ1, the second inclination angle θ2 and the attitude information, and to cause action of the actuator 5 when the actual slope angle is not consistent with a preset target slope angle, so as to adjust the attitude of the blade 2 to the preset target slope angle. The controller 11 may control the electro-proportional valve 12 through the PWM port to realize the action of the actuator 5, thereby implementing adjusting the attitude of the blade 2. The preset target slope angle may be stored in the controller 11 in advance according to the requirements of the operating conditions, or may be input through the signal input interface 111.

For example, the controller 11 is a computing device in which one or more microcontrollers are added, and implements an execution process by reading and loading executable instructions or codes from a computer-readable medium. The controller 11 may be a controller such as a PLC, a DSP, or a single-chip microcomputer, or may be composed of an integrated circuit.

In this embodiment, in the case where the road surface in construction by the grader is uneven, it is possible that when the actual slope angle is calculated, in addition to considering the attitude of the blade 2 relative to the grader, the influence of the uneven road surface on the actual slope angle is also adequately considered, so that it is possible to accurately obtain the actual slope angle, and control the slope angle in real time when the grader performs slope scraping operation, and cause that the actual slope angle keeps consistent with the preset target slope angle. In this way, it is possible to improve the operation accuracy in slope scraping construction, reduce the errors, and avoid multiple repeated reconditioning operations, thereby enhancing the construction efficiency and degree of automation, reduce the labor intensity of the operator, and implement suitability for complex construction conditions.

Figure 3:
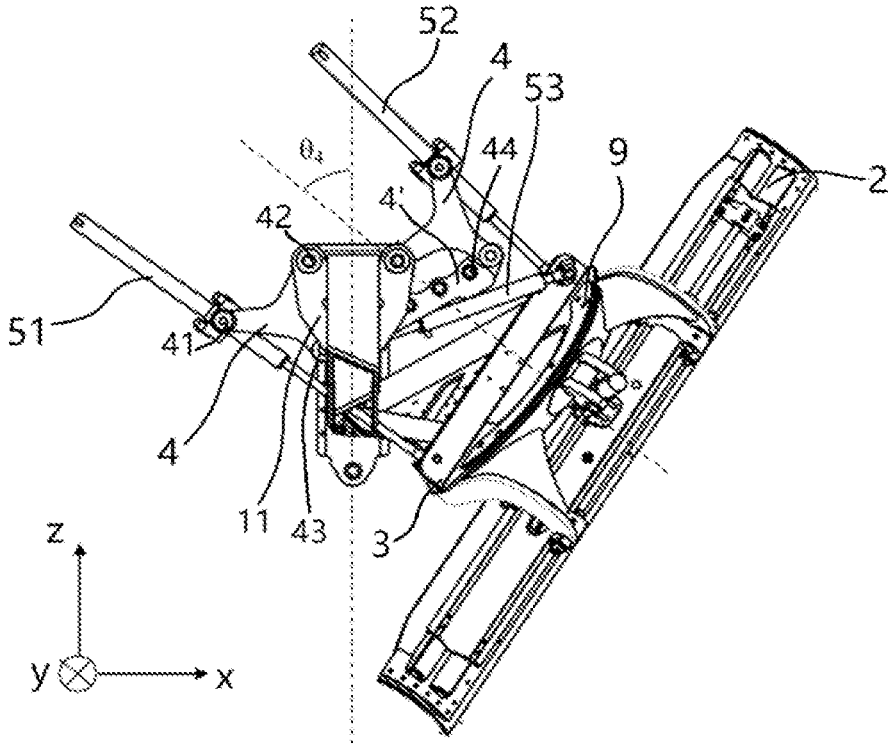
FIG. 3 is a rear view of the adjusting mechanism of the blade in the grader according to the present disclosure.
Figure 5:
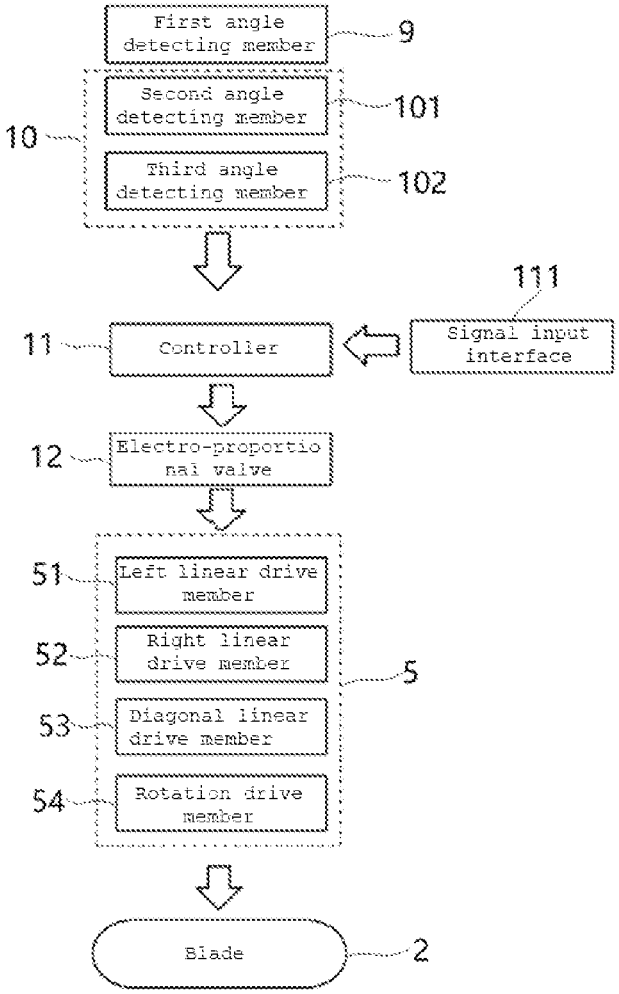
FIG. 5 is a schematic view of the module composition of the grader according to the present disclosure.

In some embodiments, as shown in FIG. 2, FIG. 3 and FIG. 5, the blade detecting member 10 includes: a second angle detecting member 101 and a third angle detecting member 102. Wherein, the second angle detecting member 101 is electrically connected to the controller 11, and configured to detect a rotary angle θ3 of the blade 2 relative to the front frame 1, where the rotary angle θ3 refers to a rotation angle of the blade 2 in a horizontal reference plane of the front frame 1. The third angle detecting member 102 is electrically connected to the controller 11, and configured to detect a swing angle θ4 of the blade 2 relative to the front frame 1, where the swing angle θ4 refers to a rotation angle of the blade 2 relative to a vertical reference plane in which the front and rear direction of the front frame 1 is situated. For example, the first angle detecting member 9 may be a gyro angle sensor, a potentiometer, a rotary encoder, and other sensors capable of implementing angle detection. The controller 11 is configured to obtain the actual slope angle of the blade 2 based on the first inclination angle θ1, the second inclination angle θ2, the rotary angle θ3 and the swing angle θ4.

In this embodiment, the second angle detecting member 101 and the third angle detecting member 102 can comprehensively reflect the attitude of the blade 2 relative to the front frame 1, so as to calculate the actual slope angle together with the first inclination angle θ1 and the second inclination angle θ2, thereby realizing the real-time control of the actual slope angle, and causing that the actual slope angle is automatically adjusted to be consistent with the preset target slope angle.

The actual slope angle of the blade 2 refers to an included angle between the tilted side slope and the horizontal plane after the slope scraping operation of the blade 2. Of course, in the present disclosure, for the convenience of understanding, the included angle between a projection of the lower edge of the blade 2 on a plane perpendicular to the forward direction of the grader and the horizontal plane is used.

The method for determining the actual slope angle will be described in detail below.

Figure 4:
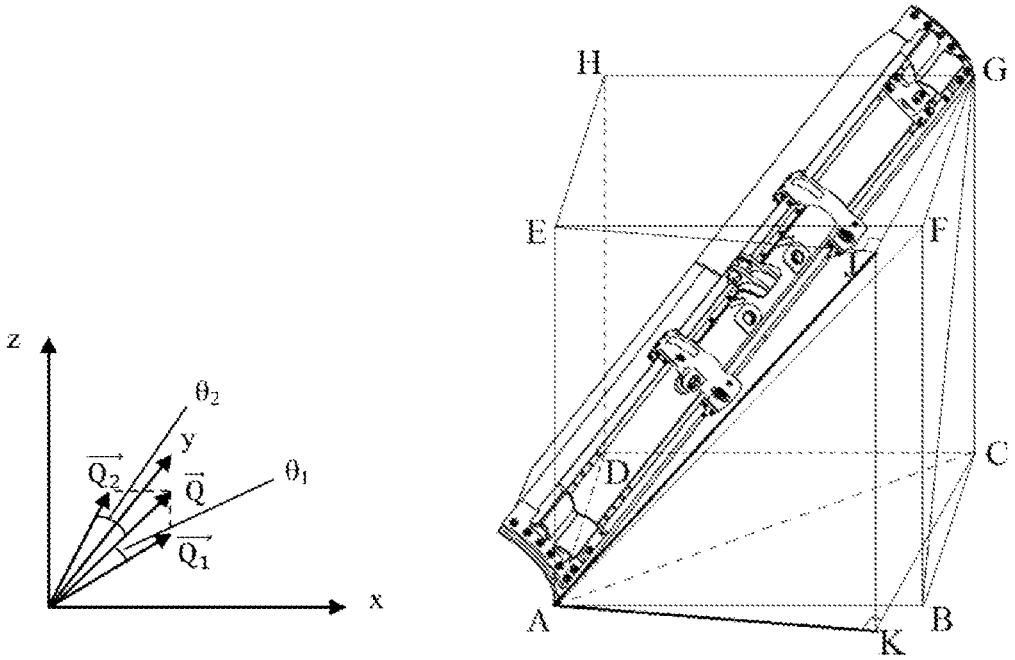
FIG. 4 is a schematic view of the movement direction of the grader and the spatial position of the blade according to the present disclosure.

During the slope scraping operation of the grader, the ground is usually uneven. As shown in FIG. 4 and FIG. 5, the inclination angles of an entirety of the grader along the forward direction and the left and right directions are θ1 and θ2 respectively, where the rotary angle of the blade 2 relative to the front frame 1 is θ3, and the swing angle of the blade 2 relative to the front frame 1 is θ4. The sensor module transmits the signal to the controller 11.

FIG. 3 shows the movement direction of the grader and the spatial position of the blade 2, where the z-axis is the direction of gravity, the x-y plane is the horizontal plane, and the z-x plane is the vertical plane perpendicular to the horizontal plane. When the grader is set to be on the horizontal plane, the z-x plane is perpendicular to the front and rear direction of the grader. When the grader is on an uneven road surface, $\vec{Q}$ is an actual forward direction of the grader, $\vec{Q_1}$ is a projection of $\vec{Q}$ on the horizontal plane x-y, $\vec{Q_2}$ is a projection of $\vec{Q}$ on the original vertical plane z-x. When the plane ABFE is set to coincide with the plane z-x, the plane AKJE is perpendicular to $\vec{Q_1}$. It is very likely to obtain that, ∠JAK is the actual slope angle of the blade 2, and ∠FAK is the slope angle of the blade 2 in the case of an even road surface when the grader is on the horizontal plane.

Therefore, a vector of the grader in the forward direction is $\vec{V_1}$:

$$\vec{V_1} = \begin{bmatrix} \sin\theta_2 \\ \cos\theta_2 \\ \sin\theta_1 \end{bmatrix}$$

A vector of the blade 2 in lower edge direction is $\vec{V_2}$:

$$\vec{V_2} = \begin{bmatrix} \cos\theta_1\sin\theta_4 + \cos\theta_4\sin\theta_1\sin \\ (-\theta_2 + \arcsin(\sec\theta_4\sec\theta_1(\sin\theta_3 + \sin\theta_4\sin\theta_1))) \\ \sin\theta_1\sin\theta_4 - \cos\theta_4\cos\theta_1\sin \\ (-\theta_2 + \arcsin(\sec\theta_4\sec\theta_1(\sin\theta_3 + \sin\theta_4\sin\theta_1))) \\ \cos\theta_4\cos(-\theta_2 + \arcsin(\sec\theta_4\sec\theta_1(\sin\theta_3 + \sin\theta_4\sin\theta_1))) \end{bmatrix}$$

For the convenience of calculation, let $\vec{V_2}$=(a, b, c), where:

$$\begin{cases} a = \cos\theta_1\sin\theta_4 + \cos\theta_4\sin\theta_1\sin\left(\begin{matrix} -\theta_2 + \arcsin \\ (\sec\theta_4\sec\theta_1(\sin\theta_3 + \sin\theta_4\sin\theta_1)) \end{matrix}\right) \\ b = \sin\theta_1\sin\theta_4 - \cos\theta_4\cos\theta_1\sin\left(\begin{matrix} -\theta_2 + \arcsin \\ (\sec\theta_4\sec\theta_1(\sin\theta_3 + \sin\theta_4\sin\theta_1)) \end{matrix}\right) \\ c = \cos\theta_4\cos(-\theta_2 + \arcsin(\sec\theta_4\sec\theta_1(\sin\theta_3 + \sin\theta_4\sin\theta_1))) \end{cases}$$

The normal vector of a plane combined by the forward direction of the grader and the edge direction of the blade 2 is $\vec{T}$:

$$\vec{T} = (x, y, z) = \begin{vmatrix} x & \sin\theta_2 & z\cos\theta_1\sin\theta_4 + \cos\theta_4\sin\theta_1\sin(-\theta_2 + \arcsin(\sec\theta_4\sec\theta_1(\sin\theta_3 + \sin\theta_4\sin\theta_1))) \\ y & \cos\theta_2 & \sin\theta_1\sin\theta_4 - \cos\theta_4\cos\theta_1\sin(-\theta_2 + \arcsin(\sec\theta_4\sec\theta_1(\sin\theta_3 + \sin\theta_4\sin\theta_1))) \\ z & \sin\theta_1 & \cos\theta_4\cos(-\theta_2 + \arcsin(\sec\theta_4\sec\theta_1(\sin\theta_3 + \sin\theta_4\sin\theta_1))) \end{vmatrix}^T$$

Let x=1, then it may be obtained that:

$$\vec{T} = \begin{bmatrix} 1 \\ \dfrac{a\cdot\cos\theta_2 - b\cdot\sin\theta_2}{b\cdot\sin\theta_1 - c\cdot\cos\theta_2} \\ \dfrac{a\cdot\sin\theta_1 - c\cdot\sin\theta_2}{c\cdot\cos\theta_2 - c\cdot\sin\theta_1} \end{bmatrix}$$

Therefore, the slope angle α of the blade 2 is an included angle between the combined planes $\vec{T}$ and $\vec{y}$ of the grader, where $\vec{y}$=(0,1,0), it may be obtained that:

$$\alpha = \arccos\langle\vec{T}, \vec{y}\rangle = \arccos\left[\frac{a\cdot\cos\theta_2 - b\cdot\sin\theta_2}{(b\cdot\sin\theta_1 - c\cdot\cos\theta_2)\left(\sqrt{1 + \left(\frac{a\cdot\cos\theta_2 - b\cdot\sin\theta_2}{b\cdot\sin\theta_1 - c\cdot\cos\theta_2}\right)^2 + \left(\frac{a\cdot\sin\theta_1 - c\cdot\sin\theta_2}{c\cdot\cos\theta_2 - c\cdot\sin\theta_1}\right)^2}\right)}\right]$$

As shown in FIG. 5, the controller 11 compares the actual slope angle α of the blade 2 obtained above with the preset target slope angle Φ, and drives action of the actuator 5 to adjust the attitude of the blade 2, so as to compare the actual slope angle α. Wherein, the preset target slope angle is defined according to actual requirements in construction, and transferred to the controller 11 by the operator through the signal input interface 111.

In some embodiments, the first angle detecting member 9 is provided on the front frame 1, for example, on the top, bottom, front or rear of the front frame 1, may be located within a central plane of the front frame 1 along the left and right direction. When the grader is on the horizontal surface, the measured value thereof is calibrated to zero.

In some embodiments, the second angle detecting member 101 which is provided on the blade 2, is configured to detect the rotary angle θ3 of the blade 2 relative to the front frame 1. Since the blade 2 is required perform operation, in order to prevent the second angle detecting member 101 from being worn during operation of the blade 2, the second angle detecting member 101 may be provided in the middle area of the top of the blade 2 along the length direction of the blade 2.

In some embodiments, as shown in FIG. 3, the grader further includes: a traction frame 3, a swing lever 4', two swing frames 4, a left linear drive member 51 and a right linear drive member 52. Wherein:

The traction frame 3 is connected below the front frame 1 through a ball hinge. The traction frame 3 may have a triangular structure. The front end of the triangular structure is connected to the front end of the front frame 1 through a ball hinge. The traction frame 3 may swing outwards entirely from the left side or the right side relative to the front frame 1, so as to perform slope scraping operation. Alternatively, it is also possible to change the left and right or front and rear inclination angle.

The swing lever 4' which may have a rod-shaped structure, is provided with a plurality of adjusting holes 44, for example, five adjusting holes 44. Correspondingly, the front frame 1 is provided with positioning holes. When the adjusting hole 44 in the middle position is fixed with the positioning hole, the blade 2 is located in the middle position in the left and right direction. When the adjusting holes 44 in the remaining positions are fixed with the positioning hole, the blade 2 swings within the vertical plane in which the left and right direction is situated. When it is necessary to adjust the swing angle of the blade 2 within the vertical plane in which the left and right direction is situated, it is possible to initially adjust a matching relationship between the adjusting hole 44 and the fixing hole, and then fine-tune the attitude of the blade 2 by the actuator 5.

Each of two swing frames 4 has a first hinge portion 41, a second hinge portion 42 and a third hinge portion 43, wherein one end of the first hinge portion 41, the second hinge portion 42 and the third hinge portion 43 are connected to form a radioactive structure. The respective second hinge portions 42 of the two swing frames 4 are hinged to the front frame 1. Specifically, the front frame 1 is provided with a mounting frame 11, and the respective second hinge portions 42 of the two swing frames 4 are hinged to the mounting frame 11. The respective third hinge portions 43 of the two swing frames 4 are respectively hinged to both ends of the swing lever 4'. For example, when the blade 2 is in the middle position, the two swing frames 4 may be arranged left and right, the two first hinge portions 41 may be located at an upper position, and the two second hinge portions 42 may be arranged oppositely in the left and right direction, and the third hinge portion 43 may be located at a lower position.

The left linear drive member 51 and the right linear drive member 52 have respective first ends hinged to the first hinge portions 41 of the two swing frames 4 respectively, and respective second ends hinged to the left and right ends of the traction frame 3 respectively. For example, the left linear drive member 51 and the right linear drive member 52 are cylinders, the first hinge 41 is connected to the cylinder barrel of the cylinder, and the swing lever 4' is connected to the piston rod of the cylinder. Alternatively, the left linear drive member 51 and the right linear drive member 52 may also be air cylinders or electric push rods.

Wherein, the third angle detecting member 102 is provided at a position where the second hinge portion 42 of at least one swing frame 4 is hinged to the front frame 1.

In this embodiment, it is possible to drive the two swing frames 4 to swing around a hinge point between the second hinge portion 42 and the front frame 1 whilst driving the traction frame 3 to swing left and right by the left linear drive member 51 and the right linear drive member 52. Accordingly, it is possible to accurately detect a swing angle θ4 of the center position of the blade 2 relative to the front frame 1 through the third angle detecting member 102, thereby accurately calculating the actual slope angle, and favorably causing the actual slope angle to keep consistent with the preset target slope angle.

In some embodiments, as shown in FIG. 3 and FIG. 4, the actual slope angle is an included angle between the normal vector of the combined plane of the grader and the front and back direction when the ground is level, where the vector of the grader in the forward direction and the vector of the blade 2 in the lower edge direction are within the combined plane.

The method for calculating the actual slope angle will be explained in detail below.

FIG. 4 shows the movement direction of the grader and the spatial position of the blade 2, where the z-axis is the direction of gravity, the x-y plane is the horizontal plane, and the z-x plane is the vertical plane perpendicular to the horizontal plane. When the grader is set to be on the horizontal plane, the z-x plane is perpendicular to the front and rear direction of the grader. When the grader is on an uneven road surface, $\vec{Q}$ is the actual forward direction of the grader, $\vec{Q_1}$ is the projection of $\vec{Q}$ on the horizontal plane x-y, $\vec{Q_2}$ is the projection of $\vec{Q}$ on the original vertical plane z-x. When the plane ABFE is set to coincide with the plane z-x, the plane AKJE is perpendicular to $\vec{Q_1}$. It is very likely to obtain that, ∠JAK is the actual slope angle of the blade 2, and ∠FAK is the slope angle of the blade 2 in a particular circumstance when the grader is on the horizontal plane.

Therefore, the vector of the grader in the forward direction is $\vec{V_1}$:

$$\vec{V_1} = \begin{bmatrix} \sin\theta_2 \\ \cos\theta_2 \\ \sin\theta_1 \end{bmatrix}$$

The vector of the blade 2 in lower edge direction is $\vec{V_2}$:

$$\vec{V_2} = \begin{bmatrix} \cos\theta_1\sin\theta_4 + \cos\theta_4\sin\theta_1\sin \\ (-\theta_2 + \arcsin(\sec\theta_4\sec\theta_1(\sin\theta_3 + \sin\theta_4\sin\theta_1))) \\ \sin\theta_1\sin\theta_4 - \cos\theta_4\cos\theta_1\sin \\ (-\theta_2 + \arcsin(\sec\theta_4\sec\theta_1(\sin\theta_3 + \sin\theta_4\sin\theta_1))) \\ \cos\theta_4\cos(-\theta_2 + \arcsin(\sec\theta_4\sec\theta_1(\sin\theta_3 + \sin\theta_4\sin\theta_1))) \end{bmatrix}$$

For the convenience of calculation, let $\vec{V_2}$=(a, b, c), where:

$$\begin{cases} a = \cos\theta_1\sin\theta_4 + \cos\theta_4\sin\theta_1\sin \\ (-\theta_2 + \arcsin(\sec\theta_4\sec\theta_1(\sin\theta_3 + \sin\theta_4\sin\theta_1))) \\ b = \sin\theta_1\sin\theta_4 - \cos\theta_4\cos\theta_1\sin \\ (-\theta_2 + \arcsin(\sec\theta_4\sec\theta_1(\sin\theta_3 + \sin\theta_4\sin\theta_1))) \\ c = \cos\theta_4\cos(-\theta_2 + \arcsin(\sec\theta_4\sec\theta_1(\sin\theta_3 + \sin\theta_4\sin\theta_1))) \end{cases}$$

The normal vector of the plane combined by the forward direction of the grader and the edge direction of the blade 2 is $\vec{T}$:

$$\vec{T} = (x, y, z) = \begin{vmatrix} x & \sin\theta_2 & z\cos\theta_1\sin\theta_4 + \cos\theta_4\sin\theta_1\sin \\ & & (-\theta_2 + \arcsin(\sec\theta_4\sec\theta_1(\sin\theta_3 + \sin\theta_4\sin\theta_1))) \\ y & \cos\theta_2 & \sin\theta_1\sin\theta_4 - \cos\theta_4\cos\theta_1\sin \\ & & (-\theta_2 + \arcsin(\sec\theta_4\sec\theta_1(\sin\theta_3 + \sin\theta_4\sin\theta_1))) \\ z & \sin\theta_1 & \cos\theta_4\cos(-\theta_2 + \arcsin(\sec\theta_4\sec\theta_1(\sin\theta_3 + \sin\theta_4\sin\theta_1))) \end{vmatrix}$$

Let x=1, then it may be obtained that:

$$\vec{T} = \begin{bmatrix} 1 \\ \dfrac{a\cdot\cos\theta_2 - b\cdot\sin\theta_2}{b\cdot\sin\theta_1 - c\cdot\cos\theta_2} \\ \dfrac{a\cdot\sin\theta_1 - c\cdot\sin\theta_2}{c\cdot\cos\theta_2 - c\cdot\sin\theta_1} \end{bmatrix}$$

Therefore, the slope angle α of the blade 2 is the included angle between the combined planes $\vec{T}$ and $\vec{y}$ of the grader, where $\vec{y}$=(0,1,0), it may be obtained that:

$$\alpha = \arccos\langle\vec{T}, \vec{y}\rangle = \arccos\left[\frac{a\cdot\cos\theta_2 - b\cdot\sin\theta_2}{(b\cdot\sin\theta_1 - c\cdot\cos\theta_2)\left(\sqrt{1 + \left(\frac{a\cdot\cos\theta_2 - b\cdot\sin\theta_2}{b\cdot\sin\theta_1 - c\cdot\cos\theta_2}\right)^2 + \left(\frac{a\cdot\sin\theta_1 - c\cdot\sin\theta_2}{c\cdot\cos\theta_2 - c\cdot\sin\theta_1}\right)^2}\right)}\right]$$

The actual slope angle α of the blade 2 obtained above is compared with the preset target slope angle Φ, and action of the actuator 5 is driven to adjust the actual slope angle α. Wherein, the preset target slope angle Φ is defined according to actual requirements in construction, and transferred to the controller 11 by the operator through the signal input interface 111.

In some embodiments, as shown in FIG. 1 to FIG. 3, the grader further includes a traction frame 3 and a rotary ring 9'. The traction frame 3 is located below the front frame 1, and connected to the front frame 1 through a ball hinge. The rotary ring 9' is arranged below the traction frame 3, and the blade 2 is connected below the rotary ring 9'. The actuator 5 includes: a left linear drive member 51, a right linear drive member 52, a diagonal linear drive member 53 and a rotary drive member 54.

Wherein, the first end of the left linear drive member 51 is rotatably connected to the front frame 1, and the second end of the left linear drive member 51 is rotatably connected to the left end of the traction frame 3, and configured to drive the left end of the traction frame 3 to move up and down. The first end of the right linear drive member 52 is rotatably connected to the front frame 1, and the second end of the right linear drive member 52 is rotatably connected to the right end of the traction frame 3, and configured to drive the right end of the traction frame 3 to move up and down. The first end of the diagonal linear drive member 53 is hinged to one end of the swing lever 4, and the second end of the diagonal linear drive member 53 is hinged to the opposite end of the traction frame 3, and configured to drive the traction frame 3 to tiltedly swing relative to the front frame 1. The rotation drive member 54 is configured to drive rotation of the rotary ring 9'. For example, the rotation drive member 54 may be a motor worm-gear box.

In this embodiment, during the operation of the grader, the left linear drive member 51, the right linear drive member 52, the diagonal linear drive member 53 and the rotary drive member 54 may adjust the attitude of the blade 2, so as to adjust the actual slope angle in real time.

In some embodiments, the controller 11 is configured to cause the actuator 5 to make an adjustment according to a sequence of three groups of priorities when the actual slope angle is inconsistent with the preset target slope angle, and shift to a next group of priority to make an adjustment when actions in a group of priority reach a limit position but have not been adjusted to the preset target slope angle. Wherein, the three groups of priorities include: a first priority, which includes at least one action of the left linear drive member 51 and the right linear drive member 52; a second priority, which includes an action of the diagonal linear drive member 53; and a third priority, which includes an action of the rotation drive member 54 to drive rotation of the rotary ring 9'.

In this embodiment, it is possible to cause the actuator to make an adjustment according to a preset sequence of priorities when the actual slope angle is inconsistent with the preset target slope angle, and there is a more significant influence on the adjustment amount of the actual slope angle when the drive member in the actuator 5 having a higher priority is adjusted. Accordingly, it is possible to improve the adjustment efficiency and implement adjusting the slope angle in real time.

In some embodiments, the controller 11 is configured to determine that the preset target slope angle cannot be reached when the actual slope angle has not reached the preset target slope angle after action of the actuator 5 according to the three groups of priorities.

In this embodiment, it is possible to determine whether the preset target slope angle is appropriate, so as to prevent the circumstance of repeated adjustment when the actual slope angle is not adjusted to the preset target slope angle.

In some embodiments, the controller 11 is configured to determine the action direction of the actuator 5 by combining the left and right slope scraping direction as well as the size relationship between the actual slope angle and the preset target slope angle, in the case where the actual slope angle is inconsistent with the preset target slope angle. For example, the left linear drive member 51, the right linear drive member 52, and the diagonal linear drive member 53 perform a projecting or retracting action, and the rotary drive member 54 rotates the rotary ring 9' clockwise or counterclockwise.

In some embodiments, the controller 11 is configured to cause the actuator 5 to stop an adjustment action when the actual slope angle reaches the preset target slope angle.

Figure 6:
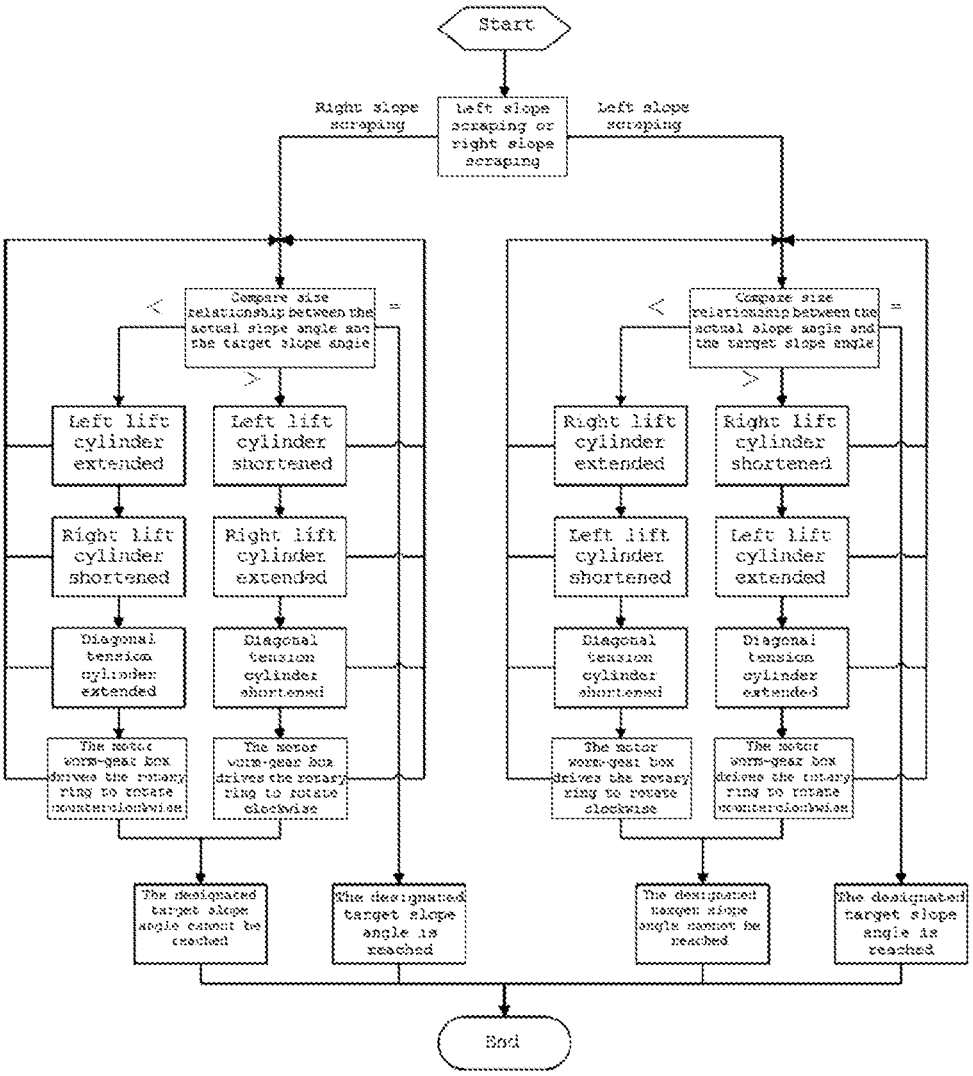
FIG. 6 is a schematic flow chart of some embodiments of the slope scraping control method of a grader according to the present disclosure.

In some embodiments, the left linear drive member 51 uses a left lift cylinder, the right linear drive member 52 uses a right lift cylinder, the diagonal linear drive member 53 uses a diagonal tension cylinder, and the rotary drive member 54 uses a motor worm-gear box. As shown in FIG. 6, when the actual slope angle is inconsistent with the preset target slope angle, it is possible to cause action of the actuator 5 to adjust the actual slope angle in the following manner.

Firstly, it is determined whether it is left slope scraping or right slope scraping. If it is a right slope scraping operation, then a size relationship between the actual slope angle and the preset target slope angle is compared, wherein:

If the actual slope angle is less than the preset target slope angle, first the left lift cylinder is extended; when the left lift cylinder is adjusted to a limit position but still does not reach the preset target slope angle, the right lift cylinder is shortened. When the right lift cylinder is adjusted to a limit position but still does not reach the preset target slope angle, the diagonal tension cylinder is extended. When the diagonal tension cylinder is adjusted to a limit position and still does not reach the preset target slope angle, the motor worm-gear box drives the rotary ring 9' to rotate counterclockwise. If the preset target slope angle is not reached after all adjustments are completed, it is indicated that the preset target slope angle cannot be achieved, and the adjustment process ends.

If the actual slope angle is greater than the preset target slope angle, first the left lift cylinder is shortened; when the left lift cylinder is adjusted to the limit position but still does not reach the preset target slope angle, the right lift cylinder is extended. When the right lift cylinder is adjusted to the limit position but still does not reach the preset target slope angle, the diagonal tension cylinder is shortened. When the diagonal tension cylinder is adjusted to the limit position and still does not reach the preset target slope angle, the motor worm-gear box drives the rotary ring 9' to rotate clockwise. If the preset target slope angle is not reached after all adjustments are completed, it is indicated that the preset target slope angle cannot be achieved, and the adjustment process ends.

If it is a left slope scraping operation, then a size relationship between the actual slope angle and the preset target slope angle is compared, wherein:

If the actual slope angle is less than the preset target slope angle, first the right lift cylinder is shortened; when the right lift cylinder is adjusted to a limit position but still does not reach the preset target slope angle, the left lift cylinder is extended. When the left lift cylinder is adjusted to a limit position but still does not reach the preset target slope angle, the diagonal tension cylinder is shortened. When the diagonal tension cylinder is adjusted to a limit position and still does not reach the preset target slope angle, the motor worm-gear box drives the rotary ring 9' to rotate clockwise. If the preset target slope angle is not reached after all adjustments are completed, it is indicated that the preset target slope angle cannot be achieved, and the adjustment process ends.

If the actual slope angle is greater than the preset target slope angle, first the left lift cylinder is extended; when the left lift cylinder is adjusted to a limit position but still does not reach the preset target slope angle, the right lift cylinder is shortened. When the right lift cylinder is adjusted to a limit position but still does not reach the preset target slope angle, the diagonal tension cylinder is extended. When the diagonal tension cylinder is adjusted to a limit position and still does not reach the preset target slope angle, the motor worm-gear box drives the rotary ring 9' to rotate counterclockwise. If the preset target slope angle is not reached after all adjustments are completed, it is indicated that the preset target slope angle cannot be achieved, and the adjustment process ends.

When the grader performs the left slope scraping operation, and the actual slope angle is less than the preset target slope angle, a sequence of priorities in adjusting the actuator 5 includes: a first priority, including the right linear drive member 52 first extended and the left linear drive member 51 then shortened; a second priority, including the diagonal linear drive member 53 shortened; and a third priority, including the rotary drive member 54 driving the rotary ring 9' to rotate clockwise; and/or When the grader performs the left slope scraping operation and the actual slope angle is greater than the target slope angle, a sequence of priorities in adjusting the actuator 5 includes: a first priority, including the right linear drive member 52 first shortened and the left linear drive member 51 then extended; a second priority, including the diagonal linear drive member 53 extended; and a third priority, including the rotary drive member 54 driving the rotary ring 9' to rotate counterclockwise; and/or When the grader performs the right slope scraping operation and the actual slope angle is greater than the target slope angle, a sequence of priorities in adjusting the actuator 5 includes: a first priority, including the left linear drive member 51 first shortened and the right linear drive member 52 then extended; a second priority, including the diagonal linear drive member 53 shortened; and a third priority, including the rotary drive member 54 driving the rotary ring 9' to rotate clockwise.

Next, the present disclosure also provides a slope scraping control method of a grader. In some embodiments, the method comprises:

Step 101: detecting a first inclination angle θ1 in a front and rear direction of the grader relative to a horizontal plane and a second inclination angle θ2 in a left and right direction of the grader relative to a horizontal plane by the first angle detecting member 9.

Step 102: detecting an attitude information of the blade 2 relative to the front frame 1 by the blade detecting member 10;

Step 103: obtaining the actual slope angle of the blade 2 based on the first inclination angle θ1 and the attitude information of the blade 2 by the controller 11;

Step 104: causing action of the actuator 5 by the controller 11, so as to adjust the attitude of the blade 2 to the target slope angle when the actual slope angle is inconsistent with the preset target slope angle.

Wherein, the steps 101 to 104 may be performed in real time during the operation of the grader. In this embodiment, in the case where the road surface in construction by the grader is uneven, it is possible that when the actual slope angle is calculated, in addition to considering the attitude of the blade 2 relative to the grader, the influence of the uneven road surface on the actual slope angle is also adequately considered, so that it is possible to accurately obtain the actual slope angle, and control the slope angle in real time when the grader performs slope scraping operation, and cause that the actual slope angle keeps consistent with the preset target slope angle. In this way, it is possible to improve the operation accuracy in slope scraping construction, reduce the errors, and avoid multiple repeated reconditioning operations, thereby enhancing the construction efficiency and degree of automation, reduce the labor intensity of the operator, and implement suitability for complex construction conditions.

In some embodiments, the step 103 of obtaining the actual slope angle of the blade 2 based on the first inclination angle θ1 and the attitude information of the blade 2 by the controller 11 includes:

Step 201: obtaining the rotary angle θ3 of the blade 2 relative to the front frame 1 detected by the second angle detecting member 101;

Step 202: obtaining the swing angle θ4 of the blade 2 relative to the front frame 1 detected by the third angle detecting member 102;

Step 203: obtaining the actual slope angle of the blade 2 based on the first inclination angle θ1, the second inclination angle θ2, the rotary angle θ3 and the swing angle θ4 by the controller 11.

In this embodiment, the second angle detecting member 101 and the third angle detecting member 102 can comprehensively reflect the attitude of the blade 2 relative to the front frame 1, so as to calculate the actual slope angle together with the first inclination angle θ1 and the second inclination angle θ2, thereby controlling the actual slope angle in real time, and causing that the actual slope angle is automatically adjusted to be consistent with the preset target slope angle.

In some embodiments, the step 203 that the controller 11 obtains the actual slope angle of the blade 2 based on the first inclination angle θ1, the second inclination angle θ2, the rotary angle θ3, and the swing angle θ4 includes:

Step 203A: calculating a vector $\vec{V_1}$ of the grader in a forward direction based on the first inclination angle θ1 and the second inclination angle θ2;

Step 203B: calculating a vector $\vec{V_2}$ of the blade 2 in the lower edge direction based on the first inclination angle θ1, the second inclination angle θ2, the rotary angle θ3 and the swing angle θ4;

Step 203C: calculating a normal vector $\vec{T}$ of a combined plane formed by the vector in the forward direction and the vector in the lower edge direction;

Step 203D: calculating an included angle between the normal vector T of the combined plane and the left and right direction as the actual slope angle α.

Wherein, the steps 203A~203D are performed in sequence. In this embodiment, when the influence of the uneven road surface on the actual slope angle is considered, it is possible to accurately obtain the actual slope angle α, and control the slope angle in real time when the grader performs slope scraping operation, and cause that the actual slope angle keeps consistent with the preset target slope angle. In this way, it is possible to improve the operation accuracy in slope scraping construction, reduce the errors, and avoid multiple repeated reconditioning operations, thereby enhancing the construction efficiency and degree of automation, reduce the labor intensity of the operator, and implement suitability for complex construction conditions.

In some embodiments, the step 104 of causing action of the actuator 5 when the actual slope angle is inconsistent with the preset target slope angle includes:

causing the actuator 5 to make an adjustment according to a first priority when the actual slope angle is inconsistent with the preset target slope angle, wherein the first priority includes at least one action of the left linear drive member 51 and the right linear drive member 52;

then making an adjustment according to a second priority when the actuator 5 reaches a limit position through actions in the first priority and has not been adjusted to the preset target slope angle, wherein the second priority includes an action of the diagonal linear drive member 53;

then making an adjustment according to a third priority when the actuator 5 reaches a limit position through actions in the second priority and has not been adjusted to the preset target slope angle, wherein the third priority includes an action of the rotary drive member 54 to drive rotation of the rotary ring 9'.

In this embodiment, it is possible to cause the actuator to make an adjustment according to a preset sequence of priorities when the actual slope angle is inconsistent with the preset target slope angle, and there is a more significant influence on the adjustment amount of the actual slope angle when the drive member in the actuator 5 having a higher priority is adjusted. Accordingly, it is possible to improve the adjustment efficiency and implement adjusting the slope angle in real time.

In some embodiments, the slope scraping control method of a grader further includes:

After causing the actuator 5 to make an adjustment according to the three groups of priorities, if the actual slope angle still does not reach the preset target slope angle, it is determined that the preset target slope angle cannot be reached.

In this embodiment, it is possible to determine whether the preset target slope angle is appropriate, and prevent a circumstance of repeated adjustment when the actual slope angle is not adjusted to the preset target slope angle.

In some embodiments, the step 104 of causing action of the actuator 5 when the actual slope angle is inconsistent with the preset target slope angle includes:

determining a left and right direction of the grader to perform slope scraping operation;

determining a size relationship between the actual slope angle and the preset target slope angle;

determining an action direction of the actuator 5 according to the left and right slope scraping direction and the size relationship between the actual slope angle and the preset target slope angle, in the case that the actual slope angle is inconsistent with the preset target slope angle.

In this embodiment, it is possible to determine the action direction of the actuator 5 according to the left and right slope scraping direction as well as the size relationship between the actual slope angle and the preset target slope angle when the actual slope angle is inconsistent with the preset target slope angle, and adjust each drive member in the actuator 5 according to a preset sequence of priorities, wherein the sequence of priorities may adopt the above-described three groups of sequence of priorities. By such method, it is possible to accurately and efficiently adjust the actual slope angle to be consistent with the preset target slope angle.

In some embodiments, the step 104 of causing action of the actuator 5 when the actual slope angle is inconsistent with the preset target slope angle includes:

When the grader performs the left slope scraping operation, and the actual slope angle is less than the preset target slope angle, a sequence of priorities in adjusting the actuator 5 includes: a first priority, including the right linear drive member 52 first extended and the left linear drive member 51 then shortened; a second priority, including the diagonal linear drive member 53 shortened; and a third priority, including the rotary drive member 54 driving the revolving circle 9 to rotate clockwise; and/or When the grader performs the left slope scraping operation and the actual slope angle is greater than the target slope angle, a sequence of priorities in adjusting the actuator 5 includes: a first priority, including the right linear drive member 52 first shortened and the left linear drive member 51 then extended; a second priority, including the diagonal linear drive member 53 extended; and a third priority, including the rotary drive member 54 driving the rotary ring 9' to rotate counterclockwise; and/or When the grader performs the right slope scraping operation and the actual slope angle is less than the target slope angle, a sequence of priorities in adjusting the actuator 5 includes: a first priority, including the left linear drive member 51 first extended and the right linear drive member 52 then shortened; a second priority, including the diagonal linear drive member 53 extended; and a third priority, including the rotary drive member 54 driving the rotary ring 9' to rotate counterclockwise; and/or When the grader performs the right slope scraping operation and the actual slope angle is greater than the target slope angle, a sequence of priorities in adjusting the actuator 5 includes: a first priority, including the left linear drive member 51 first shortened and the right linear drive member 52 then extended; a second priority, including the diagonal linear drive member 53 shortened; and a third priority, including the rotary drive member 54 driving the rotary ring 9' to rotate clockwise.

In some embodiments, the slope scraping control method of a grader further includes:

causing the actuator 5 to stop an adjustment action when the actual slope angle is adjusted to reach the preset target slope angle.

In this embodiment, it is possible to stop adjusting the attitude of the blade 2 when the actual slope angle is adjusted to reach the preset target slope angle, and continue to perform detection, and make adjustment again when it is determined that the actual slope angle is adjusted to be inconsistent with the preset target slope angle.

In addition, the present disclosure provides a slope scraping control device for a grader, comprising: a memory, which may be a magnetic disk, a flash memory or any other non-volatile storage medium; and a processor coupled to the memory. The processor is configured to implement the slope scraping control method of a grader in the above-described embodiments based on instructions stored in the memory, and the processor may be implemented as one or more integrated circuits, such as a microprocessor or a microcontroller.

The processor may be coupled to the memory via the BUS. The slope scraping control device of the grader may also be connected to an external storage device through a storage interface to call external data, and may also be connected to a network or another computer system through a network interface.

Finally, the present disclosure provides a computer-readable storage medium on which computer program instructions are stored. The instructions, when executed by a processor, implement the slope scraping control method of a grader in the above-described embodiments.

Those skilled in the art will appreciate that the embodiments of the present invention may be provided as a method, device, or computer program product. Accordingly, the present invention may take the form of a completely hardware embodiment, a completely software embodiment, or an embodiment combining software and hardware aspects. Moreover, the present invention may take the form of a computer program product embodied in one or more computer-usable non-transitory storage media (including but not limited to disk memory, CD-ROM, optical memory, and the like) containing computer usable program codes therein.

The grader provided by the present disclosure is introduced in detail above. Specific examples are applied herein to describe the principles and implementations of the present disclosure, and the descriptions of the above embodiments are only intended to help understand the method of the present disclosure and core ideas thereof. It should be set forth that, for those of ordinary skill in the art, without departing from the principles of the present disclosure, it is also possible to make several improvements and modifications to the present disclosure, which also fall within the protection scope of the claims of the present disclosure.

What is claimed is:

1. A grader, comprising:

a front frame;

a blade mounted on the front frame, wherein an attitude of the blade relative to the front frame is adjustable;

an actuator configured to adjust the attitude of the blade;

a traction frame connected below the front frame through a ball hinge;

a swing lever:

two swing frames, each of which has a first hinge portion, a second hinge portion, and a third hinge portion, wherein the respective second hinge portions of the two swing frames are hinged to the front frame, and the respective third hinge portions of the two swing frames are respectively hinged to both ends of the swing lever; and a left linear drive member and a right linear drive member, wherein the respective first ends are hinged to the respective first hinge portions of the two swing frames respectively, and the respective second ends are hinged to a left end and a right end of the traction frame respectively;

a first angle detecting member configured to detect a first inclination angle (θ1) in a front and rear direction of the grader relative to a horizontal plane and a second inclination angle (θ2) in a left and right direction of the grader relative to a horizontal plane;

a blade detecting member configured to detect attitude information of the blade relative to the front frame, wherein the blade detecting member comprises: a second angle detecting member configured to detect a rotary angle (θ3) of the blade relative to the front frame and a third angle detecting member configured to detect a swing angle (θ4) of the blade relative to the front frame, the third angle detecting member is arranged at a position where the second hinge portion of at least one of the swing frames is hinged to the front frame; and a controller configured to obtain an actual slope angle of the blade based on the first inclination angle (θ1), the second inclination angle (θ2), the rotary angle (θ3) and the swing angle (θ4), and cause action of the actuator to adjust the attitude of the blade to a preset target slope angle when the actual slope angle is inconsistent with the preset target slope angle.

2. The grader according to claim 1, wherein, the first angle detecting member is arranged on the front frame; and/or the second angle detecting member is arranged on the blade.

3. The grader according to claim 1, wherein the actual slope angle is an included angle between a normal vector of a combined plane of the grader and a front and rear direction when the ground is horizontal, and a vector of the grader in a forward direction and a vector of the blade in a lower edge direction is located within the combined plane.

4. The grader according to claim 1, further comprising a traction frame and a rotary ring, wherein the traction frame is connected below the front frame through a ball hinge, and the rotary ring is arranged below the traction frame, and the blade is connected below the rotary ring, and the actuator comprising:

a left linear drive member, wherein a first end of the left linear drive member is rotatably connected to the front frame, and a second end of the left linear drive member is rotatably connected to a left end of the traction frame and configured to drive the left end of the traction frame to move up and down;

a right linear drive member, wherein a first end of the right linear drive member is rotatably connected to the front frame, and a second end of the right linear drive member is rotatably connected to a right end of the traction frame and configured to drive the right end of the traction frame to move up and down;

a diagonal linear drive member configured to drive the traction frame to tilt and swing relative to the front frame; and a rotation drive member configured to drive rotation of the rotary ring.

5. The grader according to claim 4, wherein the controller is configured to cause the actuator to make an adjustment according to a sequence of three groups of priorities when the actual slope angle is inconsistent with the preset target slope angle, and shift to a next group of priority to make an adjustment when actions in a group of priority reach a limit position but have not been adjusted to the preset target slope angle;

wherein the three groups of priorities comprise: a first priority, which comprises at least one action of the left linear drive member and the right linear drive member; a second priority, which comprises an action of the diagonal linear drive member; and a third priority, which comprises an action of the rotation drive member to drive rotation of the rotary ring.

6. The grader according to claim 5, wherein the controller is configured to determine that the preset target slope angle cannot be reached when the actual slope angle has not reached the preset target slope angle after action of the actuator according to the three groups of priorities.

7. The grader according to claim 1, wherein the controller is configured to determine an action direction of the actuator according to a left and right slope scraping direction as well as a size relationship between the actual slope angle and the preset target slope angle, in the case where the actual slope angle is inconsistent with the preset target slope angle.

8. A slope scraping control method of a grader, comprising the steps of:

detecting a first inclination angle (θ1) in a front and rear direction of the grader relative to a horizontal plane and a second inclination angle (θ2) in a left and right direction of the grader relative to a horizontal plane by a first angle detecting member;

detecting attitude information of a blade relative to a front frame by a blade detecting member;

obtaining an actual slope angle of the blade based on the first inclination angle (θ1) and the attitude information of the blade by a controller; and causing action of the actuator by the controller so as to adjust an attitude of the blade to an target slope angle when the actual slope angle is inconsistent with the preset target slope angle, wherein the step of obtaining an actual slope angle of the blade based on the first inclination angle (θ1) and the attitude information of the blade by a controller comprises:

obtaining a rotary angle (θ3) of the blade relative to a front frame detected by a second angle detecting member;

obtaining a swing angle (θ4) of the blade relative to the front frame detected by a third angle detecting member;

obtaining an actual slope angle of the blade based on the first inclination angle (θ1), the second inclination angle (θ2), the rotary angle (θ3), and the swing angle (θ4) by the controller wherein the step of causing action of the actuator when the actual slope angle is inconsistent with the preset target slope angle comprises:

causing the actuator to make an adjustment according to a first priority when the actual slope angle is inconsistent with the preset target slope angle, wherein the first priority comprises at least one action of a left linear drive member and a right linear drive member;

making an adjustment according to a second priority when the actuator reaches a limit position through actions in the first priority and has not been adjusted to the preset target slope angle, wherein the second priority comprises an action of a diagonal linear drive member;

making an adjustment according to a third priority when the actuator reaches a limit position through actions in the second priority and has not been adjusted to the preset target slope angle wherein the third priority comprises an action of the rotary drive member to drive rotation of the rotary ring.

9. The slope scraping control method of a grader according to claim 8, wherein the step of obtaining an actual slope angle of the blade based on the first inclination angle (θ1), the second inclination angle (θ2), the rotary angle (θ3), and the swing angle (θ4) by the controller comprises:

calculating a vector of the grader in a forward direction based on the first inclination angle (θ1) and the second inclination angle (θ2);

calculating a vector of the blade in a lower edge direction based on the first inclination angle (θ1), the second inclination angle (θ2), the rotary angle (θ3) and the swing angle (θ4);

calculating a normal vector of a combined plane formed by the vector in the forward direction and the vector in the lower edge direction; and calculating an included angle between the normal vector of the combined plane and the left and right direction as the actual slope angle.

10. The slope scraping control method of a grader according to claim 8, further comprising that:

causing the actuator to make an adjustment according to the three groups of priorities, and if the actual slope angle still does not reach the preset target slope angle, it is determined that the preset target slope angle cannot be reached.

11. The slope scraping control method of a grader according to claim 8, further comprising:

causing the actuator to stop an adjustment action when the actual slope angle is adjusted to reach the preset target slope angle.

12. A slope scraping control device for a grader, comprising:

a memory; and a processor coupled to the memory, wherein the processor is configured to implement the slope scraping control method of a grader according to claim 8 based on instructions stored in the memory.

13. A computer-readable storage medium having computer program instructions stored thereon, wherein the instructions, when executed by a processor, implement the slope scraping control method of a grader according to claim 8.

14. A slope scraping control method of a grader, comprising the steps of:

detecting a first inclination angle (θ1) in a front and rear direction of the grader relative to a horizontal plane and a second inclination angle (θ2) in a left and right direction of the grader relative to a horizontal plane by a first angle detecting member;

detecting attitude information of a blade relative to a front frame by a blade detecting member;

obtaining an actual slope angle of the blade based on the first inclination angle (θ1) and the attitude information of the blade by a controller; and causing action of the actuator by the controller so as to adjust an attitude of the blade to an target slope angle when the actual slope angle is inconsistent with the preset target slope angle, wherein the step of causing action of the actuator when the actual slope angle is inconsistent with the preset target slope angle comprises:

determining a left and right direction of the grader to perform slope scraping operation;

determining a size relationship between the actual slope angle and the preset target slope angle;

determining an action direction of the actuator according to the left and right slope scraping direction and the size relationship between the actual slope angle and the preset target slope angle, in the case that the actual slope angle is inconsistent with the preset target slope angle, when the grader performs a left slope scraping operation, and the actual slope angle is less than the preset target slope angle, a sequence of priorities in adjusting the actuator comprises: a first priority, comprising a right linear drive member first extended and a left linear drive member then shortened; a second priority, comprising a diagonal linear drive member shortened; and a third priority, comprising a rotary drive member driving a rotary ring to rotate clockwise; and/or when the grader performs a left slope scraping operation and the actual slope angle is greater than the target slope angle, a sequence of priorities in adjusting the actuator comprises: a first priority, comprising a right linear drive member first shortened and a left linear drive member then extended; a second priority, comprising a diagonal linear drive member extended; and a third priority, comprising a rotary drive member driving a rotary ring to rotate counterclockwise; and/or when the grader performs a right slope scraping operation and the actual slope angle is less than the target slope angle, a sequence of priorities in adjusting the actuator comprises: a first priority, comprising a left linear drive member first extended and a right linear drive member then shortened; a second priority, comprising a diagonal linear drive member extended; and a third priority, comprising a rotary drive member driving a rotary ring to rotate counterclockwise; and/or when the grader performs a right slope scraping operation and the actual slope angle is greater than the target slope angle, a sequence of priorities in adjusting the actuator comprises: a first priority, comprising a left linear drive member first shortened and a right linear drive member then extended; a second priority, comprising a diagonal linear drive member shortened; and a third priority, comprising a rotary drive member driving a rotary ring to rotate clockwise.

* * * * *